United States Patent [19]

Hart et al.

[11] 3,983,945

[45] Oct. 5, 1976

[54] CLAMPING MECHANISM FOR MOTOR GRADER MOLDBOARDS

[75] Inventors: Francis H. Hart, Sao Paulo, Brazil; Galen I. Underwood, Warrensburg, Ill.

[73] Assignee: Caterpillar Tractor Co., Peoria, Ill.

[22] Filed: June 11, 1975

[21] Appl. No.: 586,110

[52] U.S. Cl. ..... 172/795; 172/788; 172/780; 172/791; 172/4.5; 172/741; 172/464

[51] Int. Cl.[2] ..... E02F 3/76; E02F 3/84

[58] Field of Search ..... 172/741, 464, 795, 788, 172/780, 791, 781, 4, 667, 4.5

[56] References Cited

UNITED STATES PATENTS 2,517,426 8/1950 Hall ..... 172/464 X 3,593,806 7/1971 Gurries ..... 172/741

*Primary Examiner*—George J. Marlo

*Attorney, Agent, or Firm*—John W. Grant

[57] ABSTRACT

A bracket is carried by the motor grader and has upper and lower slots formed therein to slidably receive an upper and a lower slide surface respectively of a slide rail arrangement which is secured to the back of the moldboard. A hydraulic jack is attached to the bracket and has an extendable and retractable rod which is operatively associated with a clamp device positioned for direct engagement with the upper slide surface for forcing the lower slide surface into rigid clamping engagement with the lower slot in the bracket upon extension of the rod.

5 Claims, 3 Drawing Figures

CLAMPING MECHANISM FOR MOTOR GRADER MOLDBOARDS

BACKGROUND OF THE INVENTION

The present invention relates to a clamping mechanism and more particularly to a clamping mechanism for rigidly retaining an adjustable moldboard of a motor grader in its adjusted grading position.

The moldboard of a motor grader is typically mounted for transverse adjustment relative to a blade circle to compensate for varying job conditions. Such transverse adjustment of the moldboard is conventionally achieved by laterally sliding movement of the moldboard upon its support and usually a loose sliding fit is provided between the support and the moldboard. Such loose fit is not detrimental to the operation of the motor grader in the majority of job applications since slight imperfections in the graded surface are not objectionable. However, on some finished grading operations, the blade disposition is automatically controlled relative to a preestablished reference and tolerances as small as from ¼ to ⅛ of an inch are required. One of the problems encountered with such operation is that the loose fit permits the blade height to fluctuate within its mounting more than the allowed tolerances.

One approach to solving this problem is disclosed in the prior art wherein the blade is raised within its guide slots and locked against the upper guide slot with a hydraulic jack through a lever arrangement. However, it appears that with such an arrangement when the blade is unlocked for adjusting its lateral position, the blade would drop down against its lower slide slot due to its weight. If such adjustment is made while the motor grader is in operation the blade would gouge out a depression in the finished surface. The depression would then have to be refilled and the surface regraded.

OBJECTS OF THE INVENTION

Accordingly, an object of this invention is to provide an improved clamping mechanism for motor grader moldboards.

Another object of this invention is to provide such an improved clamping mechanism for motor grader moldboards which permits the moldboard to be unclamped and moved laterally without changing its vertical position.

Other objects and advantages of the present invention will become more readily apparent upon reference to the accompanying drawings and following description.

DESCRIPTION OF THE PREFERRED EMBODIMENT

Figure 1:
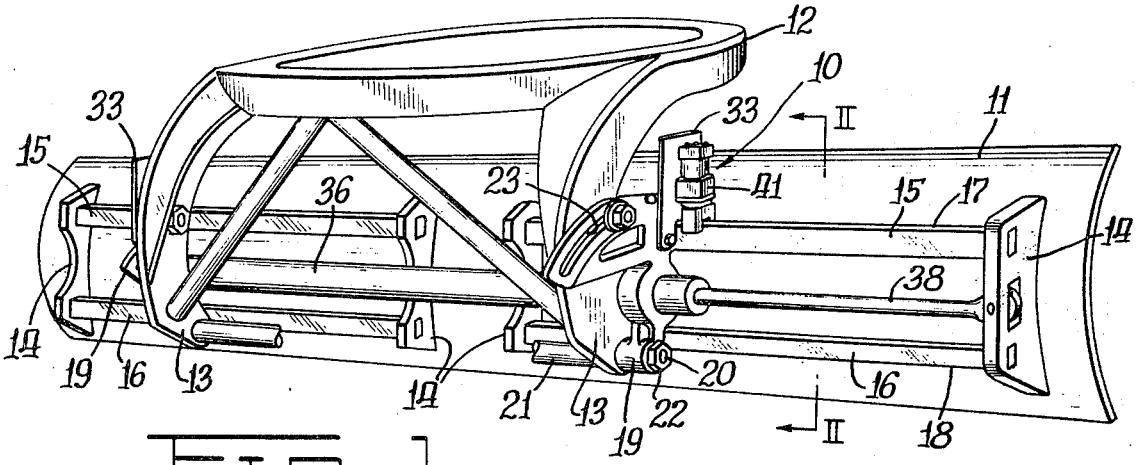
FIG. 1 is a perspective view of the clamping mechanism for motor grader moldboards embodying the principles of the present invention.
Figure 2:
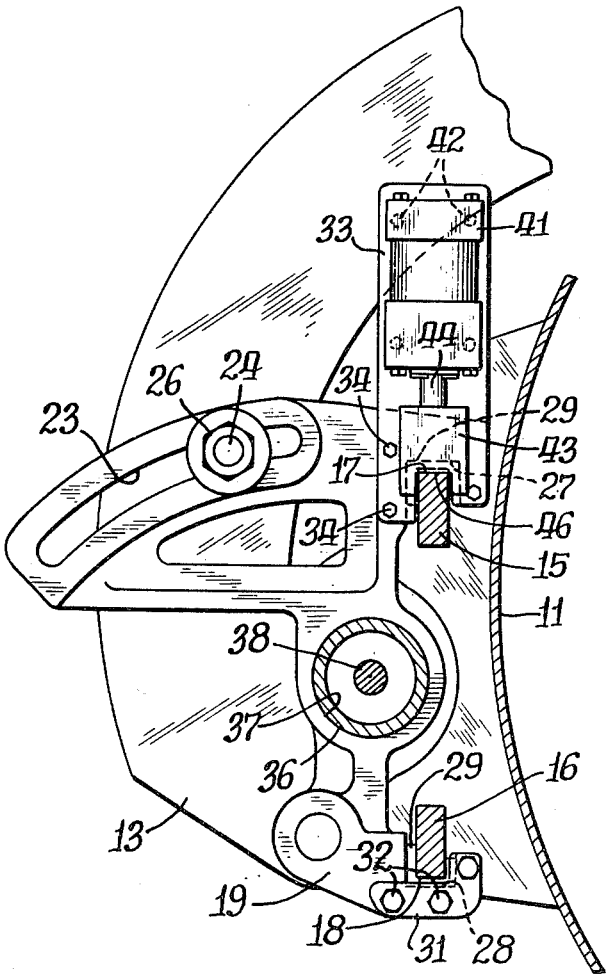
FIG. 2 is a cross sectional view through the moldboard taken along line II—II of FIG. 1.

Referring now to the drawings, a clamping mechanism for motor grader moldboards embodying the principles of the present invention is indicated by the reference numeral 10 in association with a blade or moldboard 11 of a motor grader, not shown. The moldboard is normally supported by attachment to a blade circle 12 of the motor grader, the blade circle having a pair of laterally spaced arms 13 which extend downwardly behind the moldboard. Four mounting brackets 14 are secured to the back side of the moldboard with one mounting bracket being disposed at each end of the moldboard with the other two being disposed intermediate the end mounting brackets at the center section of the moldboard. A pair of spaced upper and lower slide rails 15 and 16 extend between each of the mounting end brackets and the adjacent intermediate mounting bracket and are fixedly secured thereto. An upper slide surface 17 is provided on the upper slide rail while a lower slide surface 18 is provided on the lower slide rail.

A pair of adjustably positionable brackets 19 are individually disposed at the lower distal ends of the arms 13 with each bracket pivoted on a respective end 20 of a cross rod 21 which extends between the arms. A nut 22 is screw threadably secured to the end of the cross rod for retaining the bracket thereon. The upper end of each bracket has an arcuate slot 23 formed therein. A bolt 24 transpierces the arm, extends through the slot of the bracket and screw threadably receives a nut 26 for clamping the bracket in a preselected position against the arm.

Each bracket 19 has an upper slot 27 and a lower slot 28 formed therein adjacent to the moldboard 11 with the slots opening toward each other. Each slot has a substantially U-shaped wear member 29 disposed therein for slidably receiving the slide rails 15 and 16. The wear member is retained within the lower slot by a pair of retainer plates, one of which is shown at 31, individually secured to opposite sides of the bracket by a plurality of bolts 32. The wear member is retained in the upper slot by a similar retainer plate on one side of the arm and a mounting plate 33 which is secured to the bracket by a plurality of bolts 34 for a later defined purpose.

A double acting hydraulic jack 36 is disposed substantially parallel to the moldboard 11 and has one end secured to one of the brackets 19 in the usual manner. The jack extends through an opening 37 formed in the other bracket and has a rod 38 attached to the end mounting bracket 14. Extension and retraction of the rod side shifts the moldboard relative to the blade circle 12.

The clamping mechanism 10 includes a double acting hydraulic jack 41 secured to the mounting plate 13 by a plurality of bolts 42 and disposed substantially in vertical alignment with the upper and lower slide rails 15 and 16. A clamp member 43 is secured to the distal end of a rod 44 of the hydraulic jack and has an inverted U-shaped notch 46 formed therein for engagement with the upper surface 17 of the upper slide rail 15.

Figure 3:
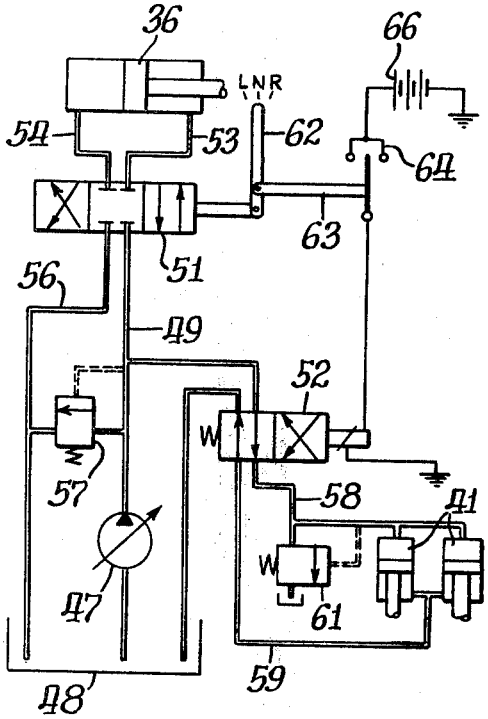
FIG. 3 is a schematic illustration of a typical control circuit for the clamping mechanism of the present invention.

As more clearly shown in FIG. 3, an exemplary hydraulic and electrical circuit for actuating the hydraulic jacks 36 and 41 includes a hydraulic pump 47 which draws fluid from a tank 48 and directs such fluid through a conduit 49 to a manually actuated control valve 51 and a solenoid actuated control valve 52. A pair of conduits 53 and 54 communicate the control valve 51 with the rod end and head end, respectively, of the hydraulic jack 36 while a conduit 56 returns the fluid exhausted from the hydraulic jack to the tank. A pressure relief valve 57 interconnects the conduits 49 and 56 to limit the maximum pressure in the hydraulic circuit. A pair of conduits 58 and 59 communicate the control valve 52 with the head ends and rod ends, respectively, of the hydraulic jacks 41. A second pressure relief valve 61 communicates with the conduit 58 to maintain a lower maximum pressure in the hydraulic circuit than that provided by the first relief valve when the control valves are in the condition shown. An actuating lever 62 is attached to the control valve 51 for shifting it to direct fluid to the hydraulic jack 36. A link 63 extends between the lever and an electrical switch 64 so that shifting the lever in either direction completes an electrical circuit from a battery 66 to energize the solenoid control valve 52 for shifting the control valve to direct fluid to the rod ends of the hydraulic jacks 41 for retraction thereof.

OPERATION

While the operation of the present invention is believed clearly apparent from the foregoing description, further amplification will subsequently be made in the following brief summary of such operation. To shift the moldboard 11 laterally relative to the blade circle 12, the lever 62 is shifted either to the R or L position. In so doing, the link 63 closes the switch 64 to complete the electrical circuit to energize the solenoid control valve 52. This shifts the control valve causing fluid to be directed through the conduit 59 to the rod ends of the hydraulic jacks 41 causing them to retract and disengage the clamp members 43 from the upper slide surfaces 17 of the upper slide rails 15 so that the moldboard may be shifted laterally relative to the blade circle 12. Shifting the lever 62 also shifts the control valve 51 thereby connecting the conduit 49 with one of the conduits 53 or 54 for retracting or extending the rod 38 of the hydraulic jack 36 which moves the moldboard 11 laterally in a corresponding direction. As the moldboard moves laterally, the lower slide surfaces 18 of the lower slide rails 16 slide in the wear members 29 disposed in the lower slots 28 of the brackets 19.

When the moldboard 11 reaches a preselected lateral position, the lever 62 and thus the control valve 51 are returned to their neutral positions blocking fluid flow to the hydraulic jack 36. Likewise, the switch 64 is opened, breaking the electrical circuit to the solenoid control valve 52 which returns to its normal position as shown in FIG. 3. In such position, pressurized fluid is directed through conduit 58 to the head ends of the hydraulic jacks 41 causing the rods 44 to extend so that the clamp members 43 engage the upper slide surfaces 17 of the upper slide rails 15 thereby forcing the lower slide rails 16 into rigid clamping engagement with the wear members 29 and slots 28 of the brackets 19.

In view of the foregoing, it is readily apparent that the structure of the present invention provides an improved clamping mechanism for motor grader moldboards which permits the moldboard to be unclamped and shifted without affecting its vertical position. This is accomplished by applying a downward force against the moldboard so that the lower slide rails are rigidly clamped against the lower slots of the brackets. Since the lower slide rails are normally seated against the lower slots due to the weight of the moldboard, there is no tendency for the moldboard to raise when the clamps are disengaged from the upper slide rails.

While the invention has been described and shown with particular reference to the preferred embodiment, it will be apparent that variations might be possible that would fall within the scope of the present invention which is not intended to be limited except as defined in the following claims.

What is claimed is:

1. A motor grader including a clamping mechanism for a moldboard mounted thereon comprising;

slide rail means secured to the back of the moldboard and having an upper and lower slide surface;

a bracket carried by the motor grader and having an upper slot and a lower slot formed therein slidably receiving the upper and lower slide surfaces, respectively;

a hydraulic jack secured to the bracket and having an extendable and retractable rod; and means operatively associated with said rod for for applying a downward force on the upper slide surface as the lower slide surface is held at a fixed elevation by the lower slot in said bracket upon extension of the rod of the hydraulic jack and for maintaining the lower slide surface in the lower slot at said fixed elevation upon retraction of the rod.

2. The motor grader of claim 1 wherein said hydraulic jack is disposed above the slide rail means with said rod in substantial alignment with the slide rail means.

3. The motor grader of claim 2 wherein said engagement means is a clamping member secured to the rod and having an inverted U-shaped notch formed therein for straddling the upper slide surface.

4. The motor grader of claim 3 wherein said slide rail means includes a pair of spaced upper and lower rails with said upper slide surface formed on the upper rail and the lower slide surface formed on the lower rail.

5. The motor grader of claim 4 including motor means for moving the moldboard laterally relative to the bracket and control means for extending the hydraulic jack so that the clamp member engages the upper slide surface whenever the motor means is not actuated and for retracting the hydraulic jack automatically to disengage the clamping member from the upper slide surface whenever the motor means is actuated.

* * * * *